US005899620A

United States Patent [19]

Pierpont

[11] Patent Number: 5,899,620

[45] Date of Patent: May 4, 1999

[54] LIPSTICK CONTAINER WITH INCREASED CARRIER RIDE-BY FORCE

[75] Inventor: Robert L. Pierpont, Meriden, Conn.

[73] Assignee: Rexam Cosmetics Packaging, Inc., Torrington, Conn.

[21] Appl. No.: 09/005,486

[22] Filed: Jan. 12, 1998

[51] Int. Cl.[6] ..... B43K 21/08

[52] U.S. Cl. ..... 401/78; 401/77; 401/55

[58] Field of Search ..... 401/78, 77, 75, 401/71, 68, 55, 49

[56] References Cited

U.S. PATENT DOCUMENTS

| | | | |
|---|---|---|---|
| 2,333,889 | 11/1943 | Ruekberg . | |
| 2,461,790 | 2/1949 | Vaughn . | |
| 3,150,770 | 9/1964 | Seaver . | |
| 3,380,795 | 4/1968 | Gruska . | |
| 3,511,575 | 5/1970 | Berins . | |
| 3,539,266 | 11/1970 | Hultgren . | |
| 3,547,550 | 12/1970 | Gruska | 401/78 |
| 3,706,354 | 12/1972 | Gruska . | |
| 4,505,607 | 3/1985 | Sugiyama . | |
| 4,579,134 | 4/1986 | Moore . | |
| 4,690,578 | 9/1987 | Idec et al. | 401/78 |
| 4,750,882 | 6/1988 | Bouix . | |
| 5,340,225 | 8/1994 | Chevassus . | |

FOREIGN PATENT DOCUMENTS

| | | |
|---|---|---|
| 1 250 404 | 12/1960 | France . |
| 2 572 267 | 10/1984 | France . |
| 63 166111 | 4/1987 | Japan . |
| 925270 | 5/1963 | United Kingdom . |
| 1323513 | 7/1973 | United Kingdom . |

*Primary Examiner*—David J. Walczak
*Attorney, Agent, or Firm*—Alston & Bird LLP

[57] ABSTRACT

A cosmetic carrier and a cosmetic container including the cosmetic carrier, the cosmetic carrier having a reinforcing flange which limits and/or prevents the cosmetic carrier from collapsing inwardly so as to dislocate the lugs from the helical channel of the outer sleeve. The cosmetic carrier includes a tubular sidewall defining a cosmetic receiving receptacle. The reinforcing flange is positioned within the cosmetic receiving receptacle of the cosmetic carrier. The cosmetic carrier also includes a pair of radially extending lugs extending outwardly from diametrically opposing surfaces of the sidewall. The reinforcing flange extends radially inwardly from the carrier sidewall so as to oppose the outwardly extending carrier lugs. Thus, the reinforcing flange is positioned within the cosmetic receiving receptacle. A plurality of ribs extend downwardly from the reinforcing flange, parallel to the longitudinal axis of the cosmetic carrier, to limit and/or prevent movement, such as rotational movement, of the cosmetic relative to the cosmetic carrier.

25 Claims, 4 Drawing Sheets

LIPSTICK CONTAINER WITH INCREASED CARRIER RIDE-BY FORCE

FIELD OF THE INVENTION

The present invention is directed to a cosmetic carrier for use in a cosmetic container.

BACKGROUND OF THE INVENTION

Conventional lipstick containers include a cosmetic carrier, a tubular inner sleeve, a tubular outer sleeve and a decorative sleeve. The cosmetic carrier supports the lipstick and is generally configured as a cup having radially outwardly extending lugs on opposing sides. The inner sleeve includes a pair of longitudinally extending slots. An outer sleeve defining a continuous helical channel is positioned about the inner sleeve. The cosmetic carrier is concentrically positioned within the inner sleeve and the carrier lugs extend through the longitudinal slots of the inner sleeve and are received within the helical channel of the outer sleeve. This results in the cosmetic carrier being moved upwardly and downwardly as the lugs traverse the length of the helical channel when the inner sleeve is rotated relative to the outer sleeve. The decorative sleeve is provided for aesthetic purposes. In operation, a bottom portion of the inner sleeve extends beyond the bottom of the outer sleeve. The user rotates the bottom portion to cause the cosmetic carrier and, hence the lipstick, to extend from the container for applying the lipstick and to retract into the container for storage.

Conventional cosmetic carriers are typically defined by an annular sidewall and a base for forming a lipstick receiving cup. A pair of diametrically opposing lugs extend radially outwardly from the outer surface of the carrier sidewall. Vertical ribs extend longitudinally upward from the base, along the inner surface of the carrier to prevent and/or limit rotational movement of the lipstick within the cosmetic carrier.

A problem associated with conventional cosmetic carriers is that the lugs of the cosmetic carrier may collapse inwardly when torque is applied to the inner sleeve and, hence, the carrier. For instance, when the cosmetic carrier is fully extended or fully retracted, further rotational force applied to the inner sleeve's rotatable base may cause the lugs of the cosmetic carrier to be forced inwardly. The lugs thereby become dislocated from within the helical channel of the outer sleeve. The force required to cause the lugs to be removed from the channel is often referred to as the "ride-by force." This may occur either by the consumer or during the assembly of the cosmetic container. For instance, with bottom-fill cosmetic carriers, the lugs may become dislocated from the helical channel when automatic spin stations are used on fill lines during the manufacture and assembly of the cosmetic container.

Problems associated with lugs which have become dislocated from the helical channel may be numerous. For instance, the carrier lugs upon becoming dislocated from the helical channel are compressed radially inwardly, thereby damaging the cosmetic contained therein. This may also impair the components of the cosmetic container and render the cosmetic container difficult to operate, even if the lugs are realigned with the helical channel of the outer sleeve. Dislocation of the lugs from the helical channel may cause the dimension across the lugs to become smaller due to compression of the plastic material which typically forms the cosmetic carrier. This may further reduce the ride-by force on subsequent operation and in some cases make the lipstick inoperable. Thus, if the force required to dislocate the lugs from the helical channel is too low, rejects during manufacturing of the cosmetic container and customer dissatisfaction may result.

SUMMARY OF THE INVENTION

The present invention overcomes the above-described drawbacks by providing a cosmetic carrier having a reinforcing flange which limits and/or prevents the cosmetic carrier from collapsing inwardly and dislocating the lugs from the helical channel of the outer sleeve. The cosmetic carrier includes a tubular sidewall defining a cosmetic receiving receptacle. The reinforcing flange is positioned within the cosmetic receiving receptacle of the cosmetic carrier. The cosmetic carrier also includes a pair of radially extending lugs extending outwardly from diametrically opposing surfaces of the sidewall. The reinforcing flange extends radially inwardly from the carrier sidewall so as to oppose the outwardly extending carrier lugs. A plurality of ribs extend downwardly from the reinforcing flange, parallel to the longitudinal axis of the cosmetic carrier, to limit and/or prevent movement, such as rotational movement, of the cosmetic relative to the cosmetic carrier.

The reinforcing flange of the cosmetic carrier is semicircular in cross-section thereby eliminating sharp angles formed between the reinforcing flange and the sidewalls of the cosmetic carrier. Sharp angles within the cosmetic receiving compartment of the carrier are disadvantageous in that they can create stress areas on the cosmetic within the cosmetic receiving receptacle. The stress areas may result in breakage when angular force is applied to the cosmetic such as when it is being applied by the consumer or assembled by the manufacturer. According to the present invention, a smooth retention surface for the lipstick thereby results.

Moreover, the vertical ribs are positioned below the reinforcing flange. As such, the vertical ribs remain within the normal filling area of the cosmetic carrier but are positioned adjacent a lower portion of the cosmetic relative to conventional carriers. The vertical ribs are also rounded to avoid sharp edges, reducing cosmetic breakage.

Accordingly, relatively greater torque, or ride-by force, is required to unintentionally dislocate the lugs of the cosmetic carrier from the outer sleeve's helical channel during manufacture and use. This results in a reduced number of rejects during the manufacturing of the cosmetic containers and improved customer satisfaction. Moreover, the cosmetic carrier according to the present invention may be used within conventional lipstick containers using existing manufacturing lines and equipment.

BRIEF DESCRIPTION OF THE DRAWINGS

The foregoing and other objects, features, and advantages of the present invention will be made apparent from the following detailed description of the preferred embodiment of the invention and from the drawings, in which.

DETAILED DESCRIPTION

The present invention will now be described more fully with reference to the accompanying drawings, in which a preferred embodiment of the invention is shown. This invention should not, however, be construed as limited to the embodiment set forth herein; rather, it is provided so that this disclosure will be thorough and complete and will fully convey the scope of the invention to those skilled in the art.

The present invention is shown and described herein as a container for applying cosmetics, such as lipstick. For the sake of brevity, the description which follows will refer to a lipstick container. However, it should be evident that the container has utility in various other areas wherein a product is to be extended from and retracted into a case. For instance, the container may be utilized for any product requiring topical application.

Figure 1:
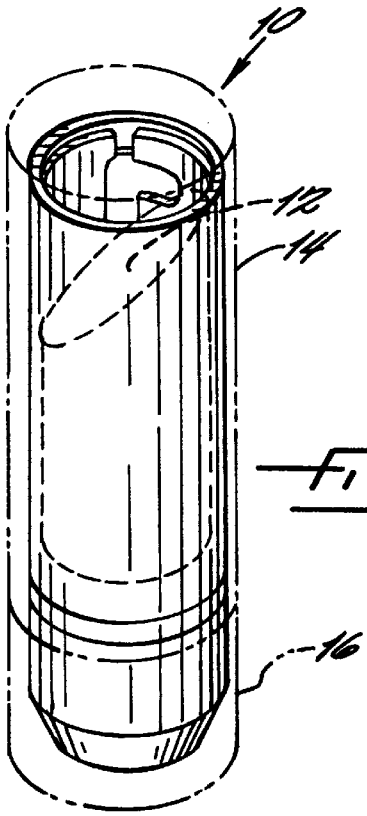
FIG. 1 is a perspective view of a cosmetic container according to the present invention.

The lipstick container of the present invention, indicated by the reference character 10, is designed for dispensing lipstick 12, shown in phantom in FIG. 1, so that it may be cosmetically applied. An outer enclosure such as a topshell 14 and baseshell 16, shown in phantom, may also be provided to protect the lipstick container 10.

Figure 2:
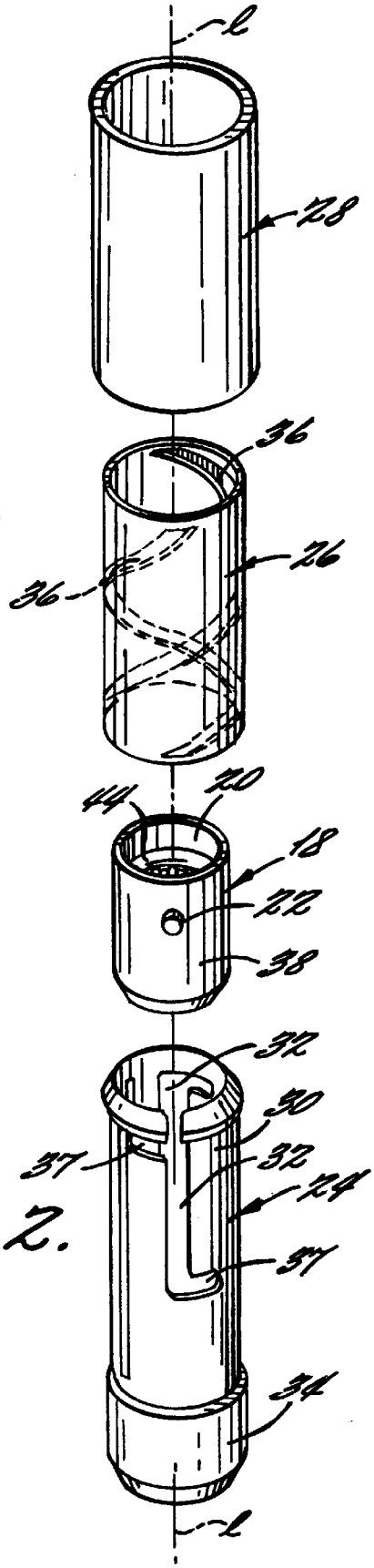
FIG. 2 is an exploded view thereof.

The lipstick container 10 includes a plurality of tubular members which are concentrically arranged about the longitudinal axis l as best illustrated in FIG. 2. The tubular members include a cosmetic carrier 18 defining a cosmetic receiving receptacle 20 for receiving the lipstick 12 therein. The cosmetic carrier 18 also includes at least one, and preferably a pair, of radially outwardly extending lugs 22. The cosmetic carrier 18 is concentrically positioned within an inner sleeve 24 which, in turn, is concentrically positioned within an outer sleeve 26. A finishing sleeve 28 may be positioned about the outer sleeve 26 for aesthetic purposes, if desired.

Figure 3:
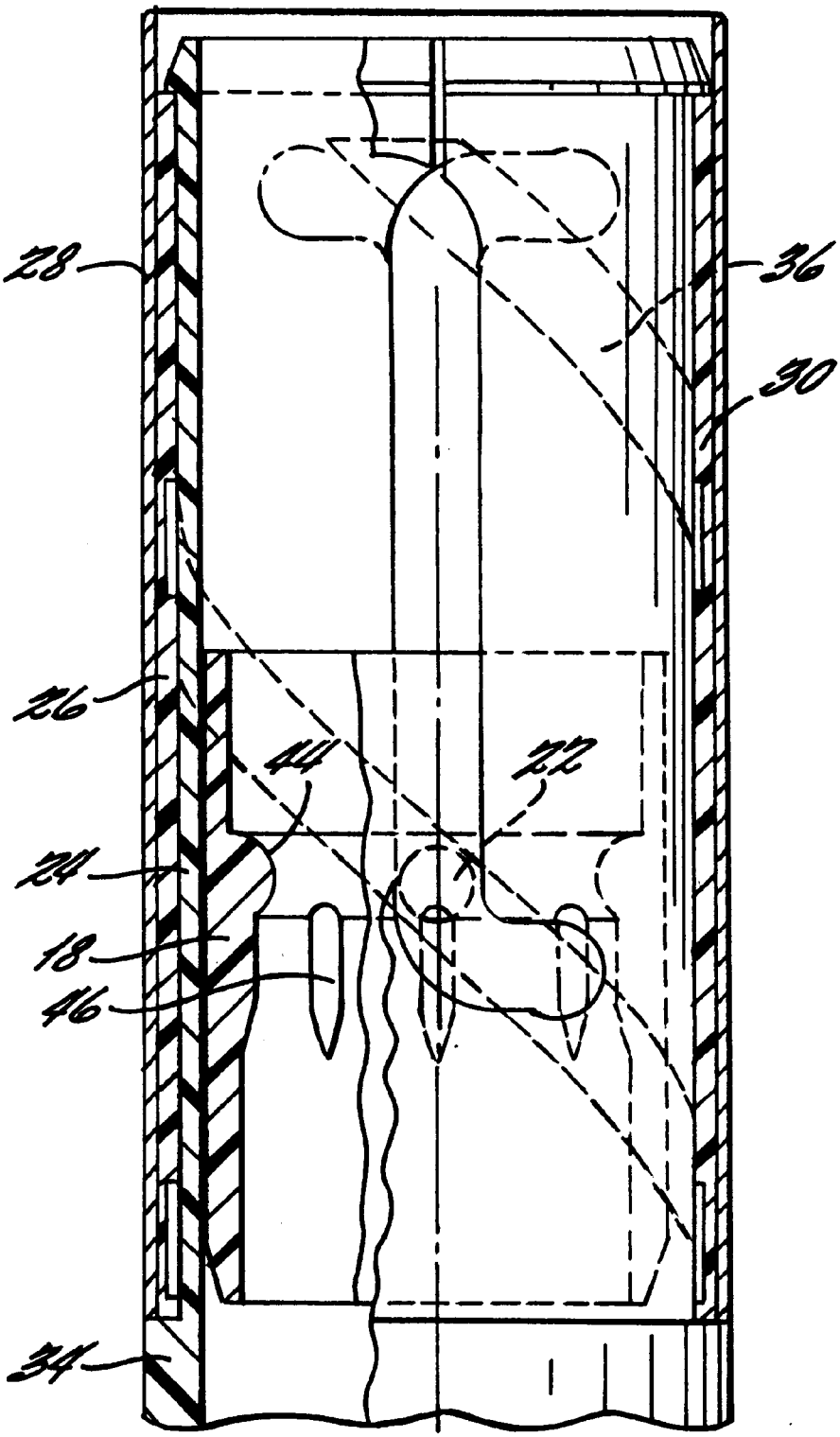
FIG. 3 is a cross-sectional view thereof.

The inner sleeve 24 and the outer sleeve 26 are preferably molded of a resilient material, such as plastic. The inner sleeve 24 is defined substantially by a relatively thin-walled tubular upper portion 30 having longitudinal slots 32 formed therein on opposing sidewalls. A thicker walled body portion 34 is formed integrally with the lower end of the upper tubular portion 30. As best illustrated in FIG. 3, the bottom portion 34 extends a distance below the outer sleeve 26 so as to provide a manually rotatable portion. Thus, the user may rotate the bottom portion 34 of the inner sleeve 24 to provide relative rotational movement between the inner sleeve 24 and the outer sleeve 26 so that the cosmetic carrier 18 may be extended or retracted to apply the lipstick 12.

At each of the upper and lower ends of the longitudinal slots 32 are provided laterally extending locking extensions 37 which, as shown, are formed integrally with the longitudinal slots 32. The locking extensions 37 limit the movement of the cosmetic carrier 18 in the fully extended and fully retracted positions. For instance, when the cosmetic carrier 18 is extended to its uppermost position, it is restrained from further upward movement because further rotatable movement of the bottom portion 34 of the inner sleeve 24 is prohibited. Likewise, when the lipstick within the cosmetic carrier 18 is fully retracted, further retraction is limited due to the retention of the lugs 22 within the lower, laterally extending locking extension 37 of the longitudinal slot 32. Thus, the lipstick may be extended by rotating the bottom portion 34 in one direction, and retracted by rotating it in the opposite direction to permit easy application while protecting the lipstick within the cosmetic container 10 when not in use.

A tubular outer sleeve 26 is positioned circumferentially around the tubular inner sleeve 24. The outer sleeve 26 has at least one helical channel 36 formed on the inner surface thereof. Preferably, two helical channels 36 are provided. The helical channels 36 are each defined by opposing upper and lower sidewalls and are configured to receive at least a portion of the lugs 22 of the cosmetic carrier 18 as shown in the various figures.

In operation, the lugs 22 of the cosmetic carrier 18 extend through the longitudinal slots 32 of the inner sleeve 24. The lugs 22 are thereby received within the helical channels 36 of the outer sleeve 26. Thus, when the bottom portion 34 of the inner sleeve 24 is rotated so as to provide relative rotational movement between the inner sleeve 24 and the outer sleeve 26, the cosmetic carrier 18 is extended and retracted along the longitudinal axis l of the lipstick container 10. The cosmetic carrier 18 rotates with the inner sleeve 24 due, at least in part, to the pair of lugs 22 which extend through the longitudinal slots 32 of the inner sleeve. Upward and downward movement of the cosmetic carrier 18 relative to the inner sleeve 24 is, however, permitted. As the inner sleeve 24 rotates when torque is applied, the cosmetic carrier 18 extends and retracts as the lugs 22 traverse the length of the helical channels 36 of the outer sleeve 26.

Figure 8:
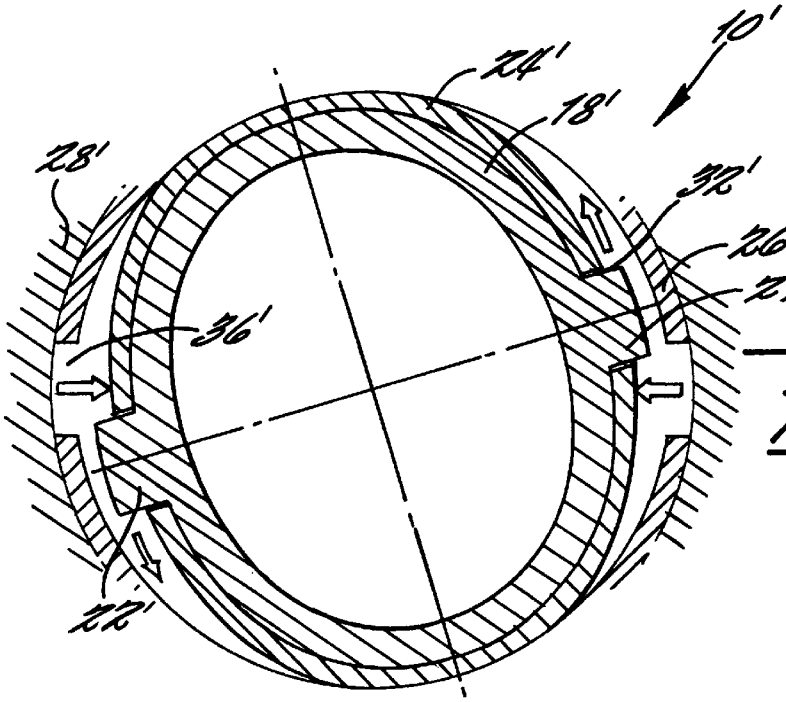
FIG. 8. PRIOR ART
FIG. 8 is a cross-sectional view, in top plan, illustrating a problem associated with prior art cosmetic containers.

As discussed in detail above, problems associated with prior art cosmetic containers include the ability of the cosmetic carrier lugs to become dislocated from the helical channel of the outer sleeve. The force required for the lugs to be removed from the helical channel is often referred to as the "ride-by force". For instance, FIG. 8 diagrammatically represents a prior art lipstick container wherein the lugs of a carrier have been dislocated from the helical channel. The prior art container 10', as illustrated in FIG. 8, includes a cosmetic carrier 18' including a pair of diametrically opposed carrier lugs 22'. The cosmetic carrier 18' is positioned within an inner sleeve 24' which is concentrically positioned within an outer sleeve 26'. The lugs 22' extend through the longitudinal slot 32' of the inner sleeve 24'. As illustrated, the lugs 22' have been dislocated from within the helical channel 36' of the outer sleeve 26'. This occurs when the lugs 22' of the cosmetic carrier 18' collapse such as when torque is applied to the inner sleeve 24' to extend and retract the cosmetic carrier 18' during use or during the assembly of the lipstick container 10'. As shown, when the lugs 22' collapse, the carrier 18' is no longer circular in cross section. This may thereby damage the cosmetic within the carrier or damage the cosmetic carrier and/or the inner 24' and outer 26' sleeves rendering the container 10' inoperative as discussed in detail above.

Figure 9:
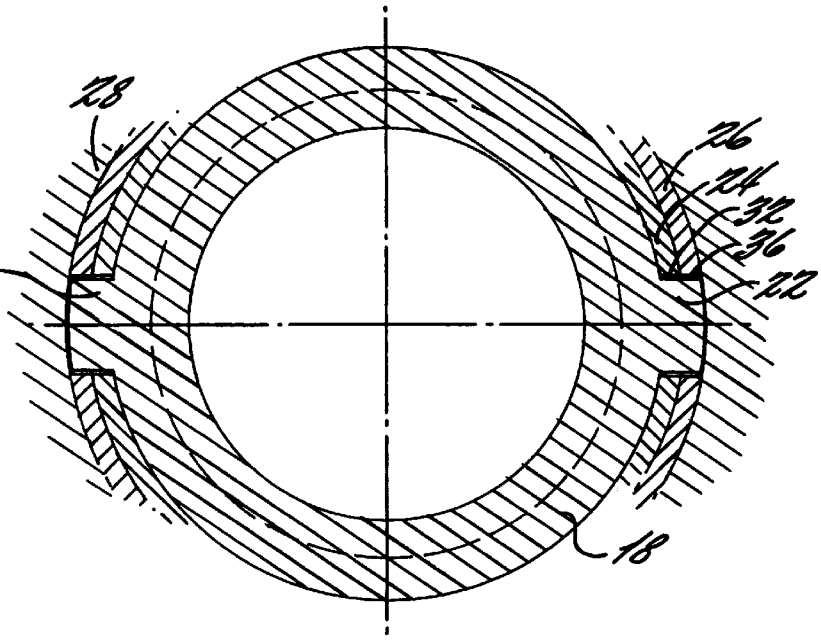
FIG. 9 is a cross-sectional view, in top plan, according to the present invention.

FIG. 9 represents the lipstick container 10 according to the present invention. The lugs 22 of the cosmetic carrier 18 are located within the helical channels 36 of the outer sleeve 26 even when torque is applied. As such, the lipstick 12 within the cosmetic receiving receptacle 20 remains undamaged. Similarly, the cosmetic carrier 18 and the outer sleeve 26 remain engaged and the structural integrity of these members is not affected. Therefore, the cosmetic container 10 remains operative.

This is achieved, at least in part, by the cosmetic carrier 18 according to the present invention. The cosmetic carrier 18 is defined by a tubular sidewall 38 from which at least one, and preferably a pair, of lugs 22 outwardly extend. The cosmetic carrier 18 includes a proximal end 40 and a distal end 42. A reinforcing flange 44 extends circumferentially along the inner surface of the tubular sidewall 38 and extends radially inwardly therefrom within the cosmetic receiving receptacle 20. Preferably, the reinforcing flange 44 is annular and encircles the cosmetic receiving receptacle 20.

The reinforcing flange 44 is positioned on the inner surface of the tubular sidewall 38 and opposes the lugs 22. Thus, the lugs 22 and the reinforcing flange 44 are positioned along the length of the tubular sidewall 38 at substantially the same axial extent between the distal 42 and proximal ends 40 thereof. The reinforcing flange 44 and lugs 22 are at least positioned adjacent a middle portion of the tubular sidewall 38, preferably, along an upper portion thereof. As illustrated, the reinforcing flange 44 is positioned closer to the proximal end 40 than the distal end 42. Accordingly, the reinforcing flange 44 extends within the cosmetic receiving receptacle 20, i.e., it is contacted by the lipstick 12 when received within the cosmetic receiving receptacle 20 of the cosmetic carrier 18.

Because the reinforcing flange 44 is positioned within the cosmetic receiving receptacle 20 of the cosmetic carrier 18, it is advantageous that sharp edges not be presented. This is because when the lipstick 12 positioned within the cosmetic receiving receptacle 20 contacts a sharp edge, stress points may be created within the lipstick 12. If sufficient angular forces are applied to the lipstick 12, breakage may be encouraged at such stress points. Preferably, the reinforcing flange 44 is semicircular in cross-section so as to avoid the presentation of sharp edges which may contact the lipstick 12. This is best illustrated in FIGS. 3–5.

Figure 4:
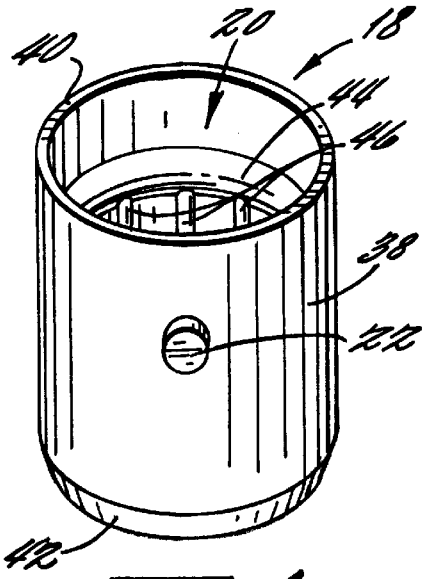
FIG. 4 is a front perspective view of the cosmetic carrier according to the present invention.
Figure 5:
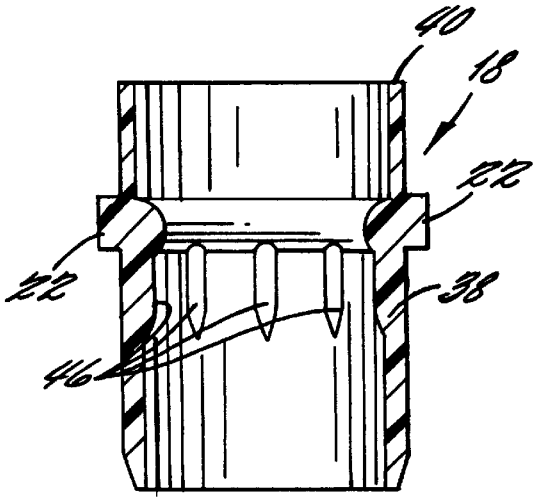
FIG. 5 is a cross-sectional view thereof.
Figure 6:
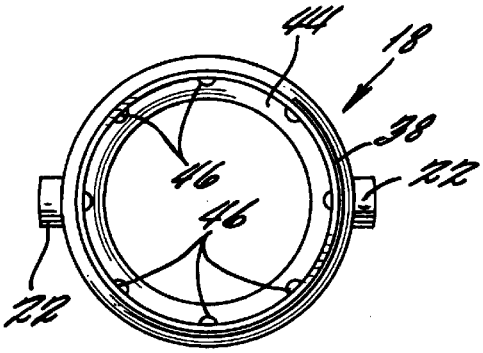
FIG. 6 is a bottom plan view thereof.
Figure 7:
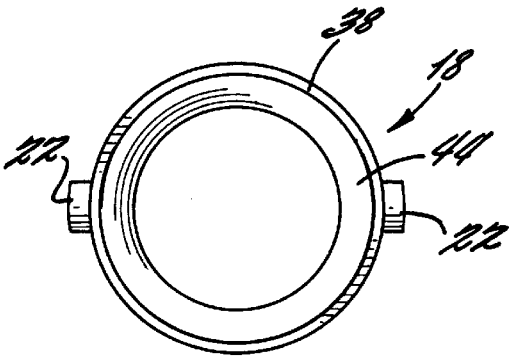
FIG. 7 is a top plan view thereof.

The cosmetic carrier 18 also includes a plurality of vertical ribs 46 best illustrated in FIGS. 4 and 5. The vertical ribs 46 are positioned within the cosmetic receiving receptacle 20, between the distal-and proximal ends 40 and 42 thereof. The vertical ribs 46 extend vertically, parallel to the longitudinal axis of the cosmetic container 10. The ribs 46 also extend downwardly from the reinforcing flange 44, in the direction of the distal end 42 of the cosmetic carrier 18. Preferably, the vertical ribs 46 are likewise semi-circular in cross section as represented in FIG. 5 so as to avoid the presentation of sharp angles within the cosmetic receiving receptacle 20. The vertical ribs 46 are provided to retain the lipstick 12 within the cosmetic receiving receptacle 20 to limit, if not prevent, rotational movement of the lipstick 12 relative to the cosmetic carrier 18.

Accordingly, when torque is applied to the inner sleeve 24, such as by rotation of the bottom portion 34 thereof, the cosmetic carrier 18 may be extended or retracted. When torque is applied, the lugs 22 of the cosmetic carrier 18 are nonetheless restrained within the helical channel 36 of the outer sleeve 26 due, at least in part, to the lateral support provided by the reinforcing flange 44. As such, when excessive torque is applied thereto, the reinforcing flange 44 sustains the structural integrity of the cosmetic carrier 18 and prevents the lugs 22 from collapsing inwardly. Thus, an increased ride-by force is required to dislocate the carrier lugs 22 from the helical channel 36. Additionally, the combination of the reinforcing flange 44 positioned within the cosmetic receiving receptacle 20 and the vertical ribs 46 provide positive retention surfaces for the lipstick 12 received within the cosmetic receiving receptacle 20.

While a particular embodiment of the invention have been described, it will be understood, of course, the invention is not limited thereto since modifications may be made by those skilled in the art, particularly in light of the foregoing teachings. It is therefore, contemplated by the appended claims to cover any such modifications that incorporate those features of these improvements in the true spirit and scope of the invention.

That which is claimed:

1. A cosmetic container for dispensing a cosmetic comprising:

a first tubular sleeve;

a cosmetic carrier concentrically positioned within said first tubular sleeve and being movable therein along the longitudinal axis of said sleeve, said cosmetic carrier comprising a tubular sidewall having a proximal and distal end and defining a cosmetic receiving receptacle, at least one lug extending radially outwardly from an outer surface of said sidewall for cooperating with said first tubular sleeve and a reinforcing flange extending circumferentially and radially inwardly from an inner surface of said sidewall at a location along said sidewall inwardly of said at least one lug to oppose said lug and to provide lateral support thereto when said carrier is moved.

2. A cosmetic container according to claim 1 wherein said reinforcing flange extends circumferentially along said sidewall substantially encircling said cosmetic receiving receptacle.

3. A cosmetic container according to claim 1 wherein said at least one lug and said reinforcing flange are positioned adjacent a middle portion of said cosmetic carrier defined between said proximal and distal ends.

4. A cosmetic container according to claim 1 wherein said at least one lug and said reinforcing flange are positioned along an upper portion of said cosmetic carrier defined between said proximal and distal ends.

5. A cosmetic container according to claim 1 wherein said reinforcing flange is semi-circular in cross section to define a smooth retention surface for cosmetic received within said cosmetic receiving receptacle.

6. A cosmetic container according to claim 1 wherein said cosmetic carrier further includes a plurality of ribs extending from said sidewall below said reinforcing flange.

7. A cosmetic container according to claim 6 wherein said plurality of ribs extend parallel to the longitudinal axis of said carrier and extend downwardly from said reinforcing flange.

8. A cosmetic container according to claim 7 wherein said at least one lug comprises a pair of diametrically opposing lugs, each positioned on said sidewall opposite said reinforcing flange.

9. A cosmetic container for dispensing a cosmetic comprising:

a tubular outer sleeve including a helical channel extending along an inner periphery thereof;

a tubular inner sleeve rotatable within said outer sleeve and including a longitudinal slot; and a cosmetic carrier concentrically positioned within said tubular inner sleeve and being movable therein along the longitudinal axis of said inner sleeve, said cosmetic carrier comprising a tubular sidewall defining a cosmetic receiving receptacle, a proximal and distal end, at least one lug extending radially outwardly from an outer surface of said sidewall and through said longitudinal slot of said inner sleeve and received within said channel of said outer sleeve, and a reinforcing flange extending circumferentially and radially inwardly from an inner surface of said sidewall at a location along said sidewall inwardly of said at least one lug to oppose said lug and to provide lateral support thereto when said carrier is moved, said reinforcing flange and said at least one lug being positioned between said proximal and distal ends of said cosmetic carrier.

10. A cosmetic container according to claim 9 wherein said reinforcing flange extends circumferentially along said sidewall substantially encircling said cosmetic receiving receptacle.

11. A cosmetic container according to claim 10 wherein said at least one lug and said reinforcing flange are positioned closer to said proximal end than to said distal end.

12. A cosmetic container according to claim 9 wherein said at least one lug and said reinforcing flange of said cosmetic carrier are positioned remote from said distal end of said carrier, at least halfway between said distal and proximal ends thereof.

13. A cosmetic container according to claim 9 wherein said reinforcing flange of said cosmetic carrier is semi-circular in cross section to define a smooth retention surface for cosmetic received within said cosmetic receiving receptacle.

14. A cosmetic container according to claim 9 wherein said cosmetic carrier further includes a plurality of ribs extending inwardly from said sidewall below said reinforcing flange.

15. A cosmetic container according to claim 14 wherein said ribs adjoin and extend from said reinforcing flange in a direction towards said distal end.

16. A cosmetic carrier for use in a cosmetic container comprising:

a tubular sidewall defining a cosmetic receiving receptacle and a proximal and distal end;

at least one lug extending radially outwardly from an outer surface of said sidewall; and a reinforcing flange extending circumferentially and radially inwardly from an inner surface of said sidewall so as to extend inwardly opposite said at least one lug to provide support thereto, said reinforcing flange and said at least one lug being positioned on said sidewall between said proximal and distal ends and said reinforcing flange extending entirely within said cosmetic receiving receptacle.

17. A cosmetic carrier according to claim 16 wherein said reinforcing flange substantially encircles said cosmetic receiving receptacle.

18. A cosmetic carrier according to claim 16 wherein said at least one lug and said reinforcing flange are positioned remote from said distal end of said carrier.

19. A cosmetic carrier according to claim 16 wherein said at least one lug and said reinforcing flange are positioned closer to said proximal end than to said distal end.

20. A cosmetic carrier according to claim 16 wherein said reinforcing flange has a semi-circular cross section to define a smooth retention surface for cosmetic received within said cosmetic receiving receptacle.

21. A cosmetic carrier according to claim 16 said carrier further includes a plurality of ribs extending between said reinforcing flange and said distal end for securing cosmetic retained within said cosmetic receiving receptacle.

22. A cosmetic carrier according to claim 21 wherein said plurality of ribs extend parallel to the longitudinal axis of said carrier and extend downwardly from said reinforcing flange toward said distal end.

23. A cosmetic carrier according to claim 16 wherein said at least one lug comprises a pair of diametrically opposing lugs.

24. A cosmetic container according to claim 9 wherein said reinforcing flange extends entirely within said cosmetic receiving receptacle.

25. A cosmetic container according to claim 1 wherein said reinforcing flange extends entirely within said cosmetic receiving receptacle.

* * * * *